US008007308B2

(12) United States Patent
Feldman et al.

(10) Patent No.: US 8,007,308 B2
(45) Date of Patent: Aug. 30, 2011

(54) ELECTRICAL CONNECTOR ASSEMBLY

(75) Inventors: Steven Feldman, Cedar Park, TX (US); Alexander W. Barr, Austin, TX (US); Joseph N. Castiglione, Cedar Park, TX (US); Daniel F. Cronch, Austin, TX (US); Rudy L. Densmore, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 241 days.

(21) Appl. No.: 12/236,754

(22) Filed: Sep. 24, 2008

(65) Prior Publication Data

US 2009/0104809 A1 Apr. 23, 2009

Related U.S. Application Data

(60) Provisional application No. 60/980,512, filed on Oct. 17, 2007.

(51) Int. Cl.
*H01R 13/64* (2006.01)

(52) U.S. Cl. ..... 439/374

(58) Field of Classification Search ..... 439/578–585, 439/680, 540.1, 374, 101, 108
See application file for complete search history.

(56) References Cited

U.S. PATENT DOCUMENTS

| | | | | |
|---|---|---|---|---|
| 5,063,659 | A | 11/1991 | Wright | |
| 5,116,230 | A * | 5/1992 | Dechelette et al. | 439/101 |
| 5,184,965 | A | 2/1993 | Myschik et al. | |
| 5,194,020 | A * | 3/1993 | Voltz | 439/579 |
| 5,222,898 | A * | 6/1993 | Fedder et al. | 439/101 |
| 5,431,578 | A | 7/1995 | Wayne | |
| 5,554,050 | A | 9/1996 | Marpoe, Jr. | |
| 5,647,766 | A | 7/1997 | Nguyen | |
| 5,700,162 | A | 12/1997 | Hatagishi et al. | |
| 5,766,036 | A | 6/1998 | Ahmad et al. | |
| 5,975,950 | A | 11/1999 | Yamaguchi | |
| 6,146,202 | A | 11/2000 | Ramey et al. | |
| 6,231,391 | B1 | 5/2001 | Ramey et al. | |
| 6,257,931 | B1 | 7/2001 | Sakurai et al. | |
| 6,368,120 | B1 | 4/2002 | Scherer et al. | |
| 6,371,813 | B2 | 4/2002 | Ramey et al. | |
| 6,498,506 | B1 | 12/2002 | Beckous | |
| 6,540,565 | B2 | 4/2003 | Babel et al. | |
| 6,764,350 | B2 | 7/2004 | Kosmala | |
| 6,780,068 | B2 | 8/2004 | Bartholoma et al. | |
| 6,780,069 | B2 | 8/2004 | Scherer et al. | |
| 6,824,427 | B1 | 11/2004 | Feldman et al. | |
| 6,849,799 | B2 | 2/2005 | Springer et al. | |
| 6,929,507 | B2 | 8/2005 | Lin | |
| 7,021,963 | B2 | 4/2006 | Feldman | |
| 7,044,789 | B2 | 5/2006 | Yohn et al. | |
| 7,134,911 | B2 | 11/2006 | Bernhart et al. | |
| 7,331,821 | B2 | 2/2008 | Feldman | |

(Continued)

FOREIGN PATENT DOCUMENTS

| | | |
|---|---|---|
| DE | 4116166 | 7/1992 |

(Continued)

*Primary Examiner* — Edwin A. Leon
(74) *Attorney, Agent, or Firm* — Johannes P. M. Kusters

(57) ABSTRACT

An electrical connector assembly includes a carrier and a plurality of terminated cable assemblies retained by the carrier. The carrier includes a plurality of first alignment elements and each terminated cable assembly includes one or more second alignment elements. The first and second alignment elements are configured to cooperatively align the plurality of terminated cable assemblies in the carrier.

25 Claims, 10 Drawing Sheets

U.S. PATENT DOCUMENTS

| | | | | |
|---|---|---|---|---|
| 7,553,187 | B2 | 6/2009 | Feldman et al. | |
| 2004/0229505 | A1 * | 11/2004 | Feldman et al. | 439/581 |
| 2005/0054237 | A1 | 3/2005 | Gladd et al. | |
| 2007/0197095 | A1 | 8/2007 | Feldman et al. | |
| 2008/0020615 | A1 | 1/2008 | Feldman et al. | |
| 2008/0020618 | A1 | 1/2008 | Feldman | |
| 2009/0221180 | A1 | 9/2009 | Feldman et al. | |

FOREIGN PATENT DOCUMENTS

| | | | |
|---|---|---|---|
| EP | 0 608 863 | A2 | 8/1994 |
| EP | 1 294 059 | A2 | 3/2003 |
| JP | 10335008 | | 12/1998 |
| JP | 2002334764 | | 11/2002 |
| WO | WO 2006/120373 | A2 | 11/2006 |

* cited by examiner

ELECTRICAL CONNECTOR ASSEMBLY

CROSS REFERENCE TO RELATED APPLICATION

This application claims the benefit of U.S. Provisional Patent Application No. 60/980,512, filed Oct. 17, 2007.

TECHNICAL FIELD

The present invention relates to high speed electrical connectors. In particular, the present invention relates to electrical connectors that provide high signal line density while also providing shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as edge rates or signal rise times) have been slow when compared to the length of time required for a signal to propagate through a conductor in the interconnect or in the printed circuit board. As user requirements grow more demanding with respect to both interconnect sizes and circuit switching speeds, the design and manufacture of interconnects that can perform satisfactorily in terms of both physical size and electrical performance have grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

In one aspect, the present invention provides an electrical connector assembly having a carrier and a plurality of terminated cable assemblies retained by the carrier. The carrier includes a plurality of first alignment elements and each terminated cable assembly includes one or more second alignment elements. The first and second alignment elements are configured to cooperatively align the plurality of terminated cable assemblies in the carrier.

In another aspect, the present invention provides an electrical connector suitable for insertion into a carrier. The electrical connector includes an electrical cable, one or more electrical contacts, an insulator, an electrically conductive shield element, and at least one second alignment element. The electrical cable includes one or more conductors and a ground shield surrounding the one or more conductors. The insulator is disposed around the one or more electrical contacts, which are connected to the one or more conductors. The electrically conductive shield element is disposed around the insulator and connected to the ground shield. The at least one second alignment element is configured to cooperate with at least one first alignment element of the carrier to align the electrical connector in the carrier.

In another aspect, the present invention provides a carrier including a plurality of first alignment elements. The first alignment elements are configured to cooperate with a plurality of second alignment elements of a plurality of mating terminated cable assemblies to align the plurality of terminated cable assemblies in the carrier.

In another aspect, the present invention provides an electrical connector system having a carrier, a plurality of terminated cable assemblies retained by the carrier, and a header configured to mate with the carrier. The carrier includes a plurality of first alignment elements and the plurality of terminated cable assemblies includes a plurality of second alignment elements. The first and second alignment elements are configured to cooperatively align the plurality of terminated cable assemblies in the carrier.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
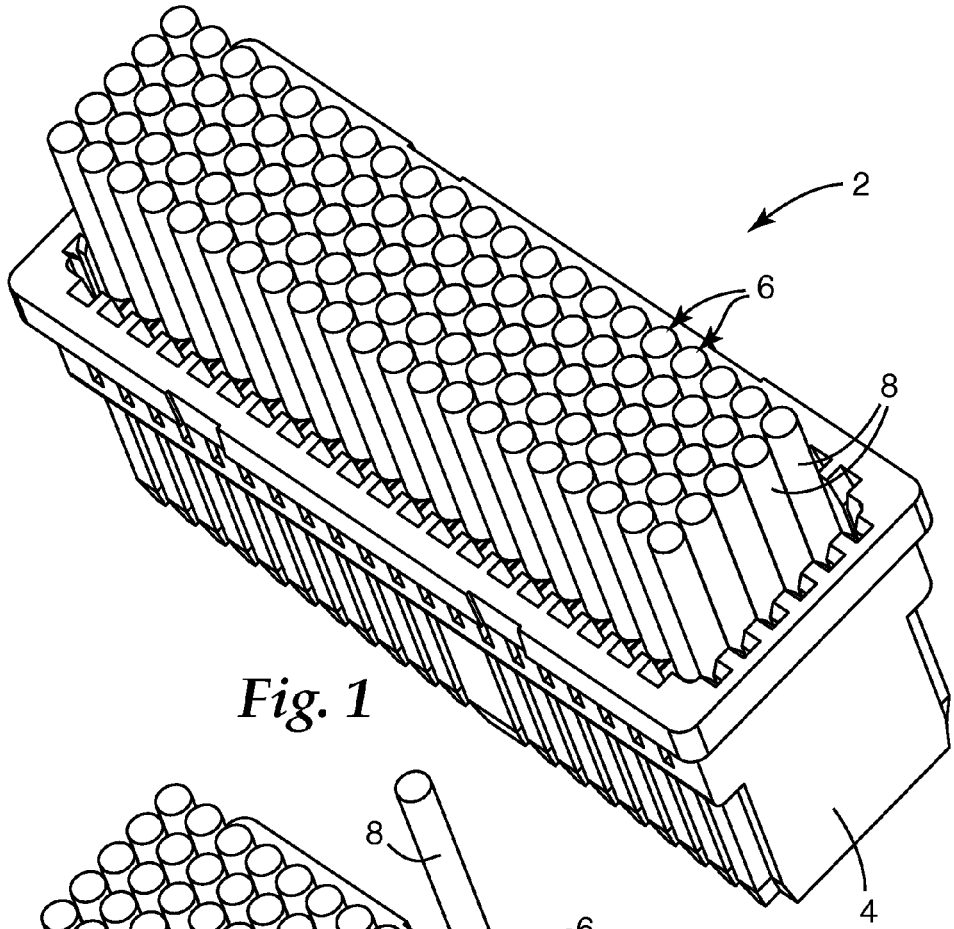
FIG. 1 is a perspective view of an exemplary embodiment of an electrical connector assembly according to an aspect of the present invention in a fully assembled configuration.
Figure 2:
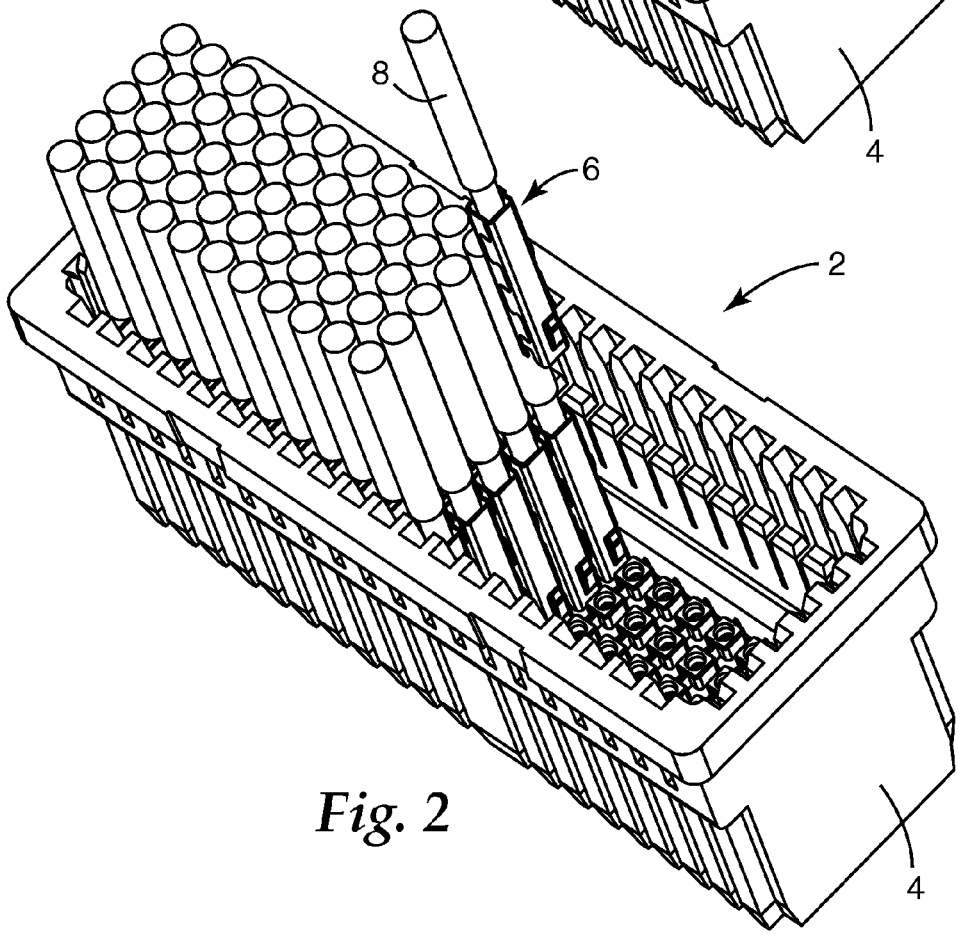
FIG. 2 is a perspective view of the electrical connector assembly of FIG. 1 in a partially assembled configuration.
Figure 4:
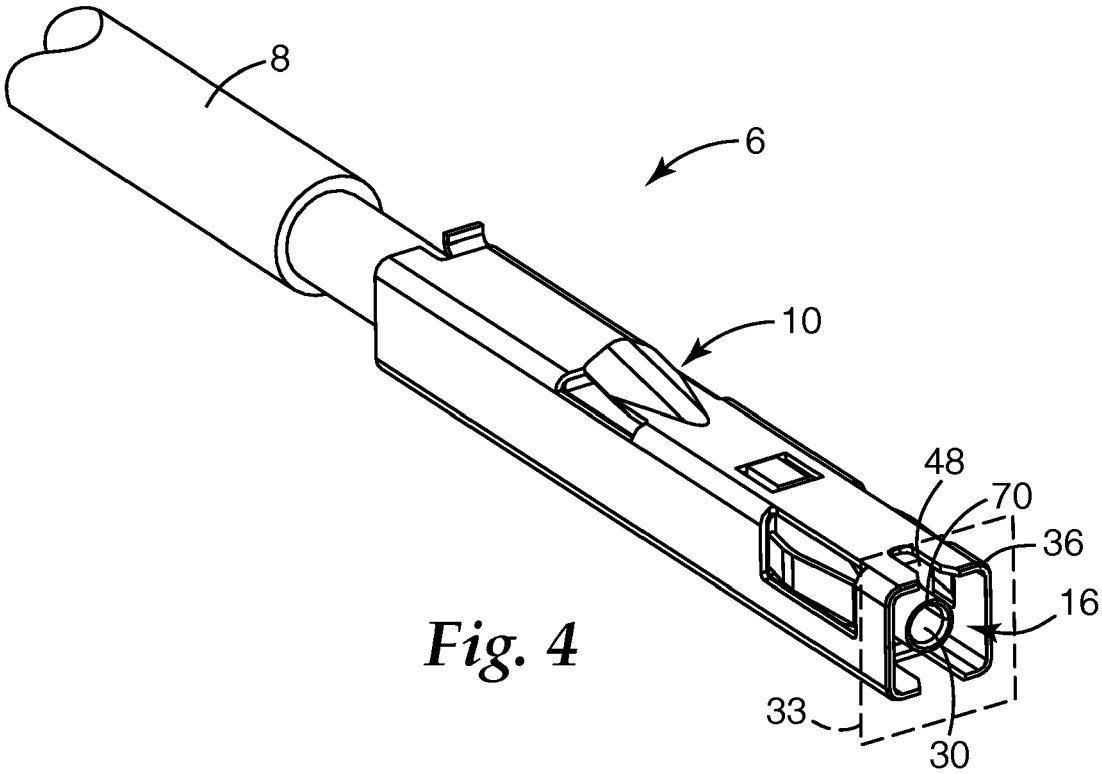
FIG. 4 is a perspective view of a terminated cable assembly that can be used in the electrical connector assembly of FIG. 1.

FIGS. 1-2 illustrate an exemplary embodiment of an electrical connector assembly according to an aspect of the present invention in a fully assembled and partially assembled configuration, respectively. Electrical connector assembly 2 includes a carrier 4 and a plurality of terminated cable assemblies 6 retained by carrier 4. As best shown in FIG. 4, terminated cable assemblies 6 include electrical cables 8 and electrical cable terminations 10. Electrical connector assembly 2 is configured to mate with a header 400 (shown in FIG. 18 and described in detail below), configured for mounting on a printed circuit board (not shown) to form an electrical connection between electrical cables 8 and the printed circuit board.

Exemplary embodiments of electrical connector assemblies are described and illustrated herein as used with a single type of electrical cable 8. However, these and other exemplary embodiments may have other types of electrical cables 8 having signal, power, and/or ground elements. Electrical cables 8 may be, but are not limited to, single wire cables (e.g., single coaxial cables and single twinaxial cables) and multi-wire cables (e.g., multiple coaxial cables, multiple twinaxial cables, and twisted pair cables). Further, different types and configurations of electrical cables 8 and electrical cable terminations 10 may be used simultaneously with the electrical connector assemblies. For example, a portion of electrical cables 8 and electrical cable terminations 10 retained by carrier 4 may be coaxial cables and terminations, while another portion of electrical cables 8 and electrical cable terminations 10 retained by carrier 4 may be twinaxial (or other) cables and terminations.

In one aspect, some elements of electrical connector assembly 2 may be constructed in a manner the same as or similar to what is taught in U.S. Patent Application Publication No. 2007-0197095 A1, published Aug. 23, 2007.

Figure 3:
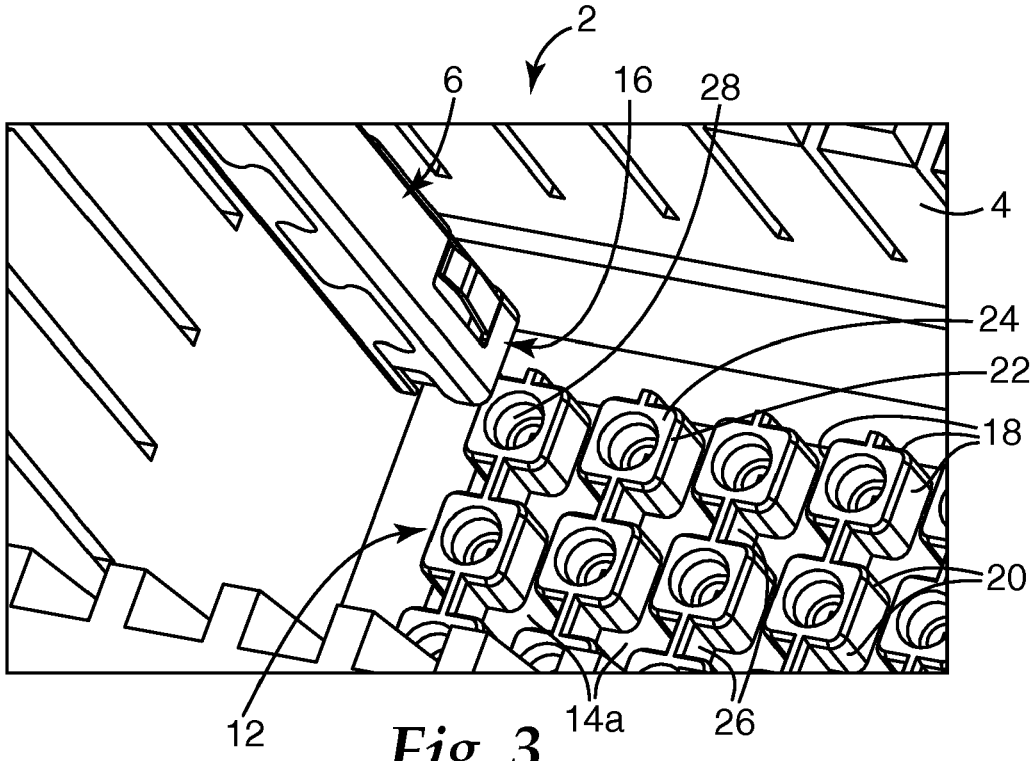
FIG. 3 is a detailed perspective view of the electrical connector assembly of FIG. 1 in a partially assembled configuration.

FIG. 3 illustrates a detail of electrical connector assembly 2 in a partially assembled configuration. In particular, it shows a detail of carrier 4 having a plurality of first alignment elements 12 extending from an internal surface 14*a* of the carrier, and a terminated cable assembly 6 having a second alignment element 16. First alignment elements 12 of carrier 4 and second alignment elements 16 of terminated cable assemblies 6 are configured to cooperatively align terminated cable assemblies 6 in carrier 4. First alignment elements 12 may be positioned in a portion of terminated cable assemblies 6 to facilitate this alignment. In the exemplary embodiment of FIG. 3, first alignment elements 12 include a top surface 24 and four side walls 18 defining a substantially square shaped alignment post. Side walls 18 may extend from internal surface 14*a* substantially perpendicularly or may have a slope to provide guidance during insertion of terminated cable assemblies 6 and injection molding of carrier 4. First alignment elements 12 may additionally include side chamfers or radii 20 and/or top chamfers or radii 22 to provide guidance and positioning during insertion of terminated cable assemblies 6 into carrier 4 and facilitate injection molding of carrier 4. In other embodiments, first alignment elements 12 may have other suitable shapes, such as, e.g. other rectilinear shapes or curvilinear shapes. First alignment elements 12 may be connected by carrier ribs 26. Carrier ribs 26 facilitate injection molding of carrier 4 and first alignment elements 12 and may be designed to provide guidance and positioning during insertion of terminated cable assemblies 6 into carrier 4. To guide and position an electrical contact 30 (described in detail below) of terminated cable assembly 6 during insertion of terminated cable assembly 6 into carrier 4, first alignment elements 12 may include an opening 28. Opening 28 may guide and position electrical contact 30 independent of the guidance and positioning of terminated cable assembly 6 into carrier 4. Independent guidance and positioning of electrical contact 30 reduces tolerance stack-ups in the assembly and provides a more precise placement of electrical contact 30 in carrier 4.

Figure 5:
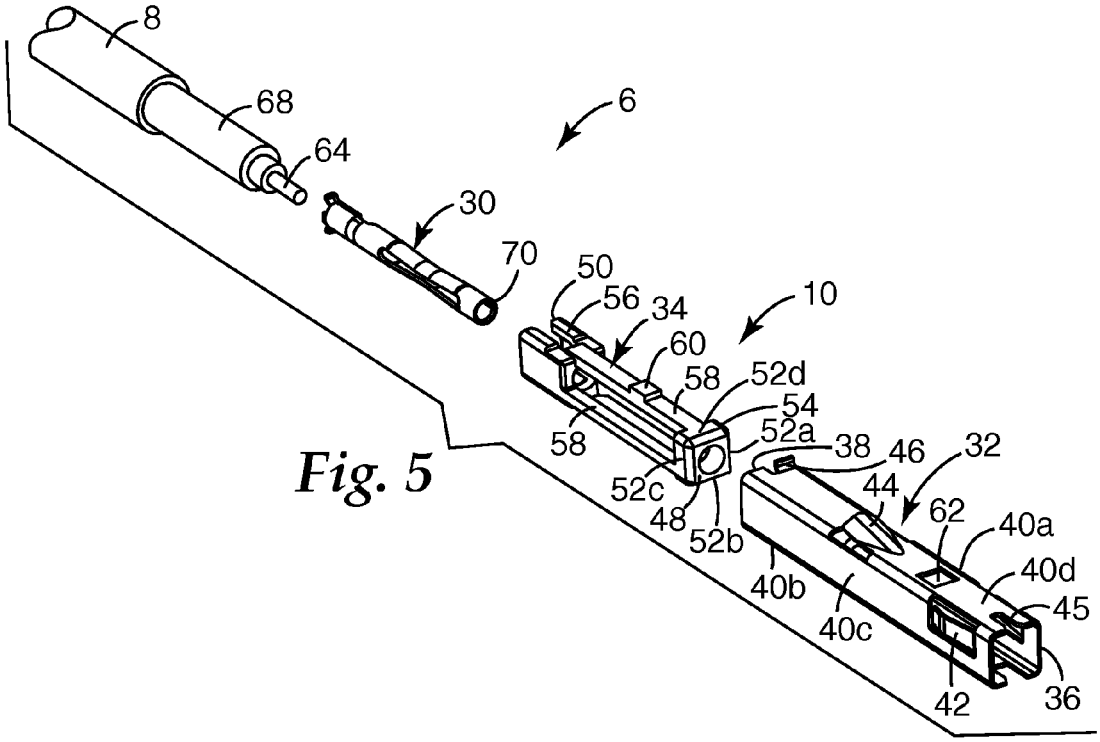
FIG. 5 is an exploded perspective view of the terminated cable assembly of FIG. 4.

FIGS. 4-5 illustrate an exemplary embodiment of a terminated cable assembly that can be used in the electrical connector assembly of FIGS. 1-3. Terminated cable assembly 6 includes an electrical cable 8 and an electrical cable termination 10.

Electrical cable termination 10 includes a longitudinal electrically conductive shield element 32, an insulator 34, and a single electrical contact 30. Electrically conductive shield element 32 has a front end 36, a back end 38, and side surfaces 40*a*-40*d* (collectively referred to herein as "sides 40") defining a non-circular transverse cross-section. Although the illustrated embodiment includes four sides 40 defining a substantially square transverse cross-section, shield element 32 may have other numbers of sides defining other generally rectangular or non-circular transverse cross-sections. In other embodiments, shield element 32 may have a generally curvilinear (such as, e.g., a circular) transverse cross-section.

As illustrated, shield element 32 includes laterally protruding resilient ground contact beams 42 disposed on opposed side surfaces 40*a* and 40*c*. In other embodiments, shield element 32 includes only a single ground contact beam 42.

A latch member 44 extends from at least one of sides 40. The latch member is configured to retain electrical cable termination 10 in a retainer or organizer plate (not shown) configured to receive, secure, and manage a plurality of electrical cable terminations. In one embodiment, latch member 44 is designed to yield (i.e., deform) at a lower force than required to break the attached electrical cable 8, so that an electrical cable termination 10 can be pulled out of the retainer or organizer plate for the purpose of replacing or repairing an individual electrical cable termination and cable assembly. In the illustrated embodiment of FIGS. 4-5, latch member 44 is shown on side 40*d*. However, in other embodiments, latch member 44 may additionally, or alternatively, be positioned on other sides 40 of shield element 32.

Shield element 32 includes carrier rib receiving apertures 45 positioned in opposed side surfaces 40*b* and 40*d* and configured to receive at least a portion of a carrier rib 26 of carrier 4. Shield element 32 may include a single carrier rib receiving aperture 45, or it may include two or more carrier rib receiving apertures 45 having a different size, shape, and/or non-symmetric placement on shield element 32, whereby carrier ribs 26 may be configured to cooperate with the two or more carrier rib receiving apertures 45 to ensure that electrical cable termination 10 is inserted into carrier 4 in the correct predetermined orientation.

Shield element 32 may further include a keying member, in the form of tab 46, laterally extending from back end 38 of shield element 32. Tab 46 is configured to ensure that electrical cable termination 10 is inserted into the retainer or organizer plate in the correct predetermined orientation. If electrical cable termination 10 is not properly oriented within the retainer or organizer plate, electrical cable termination 10 cannot be fully inserted. In one embodiment, tab 46 is deformable (such as by the use of a tool or the application of excess force in the insertion direction) and may be straightened to allow a damaged or defective electrical cable termination 10 to be pushed completely through the retainer or organizer plate, such that the damaged or defective components can be replaced or repaired.

Although the figures show that shield element 32 includes ground contact beams 42, it is within the scope of the present invention to use other contact element configurations, such as Hertzian bumps, in place of contact beams 42.

Insulator 34 has a front end 48, a back end 50, and outer surfaces 52*a*-52*d* (collectively referred to herein as "outer surface 52") defining a non-circular shape. Although the illustrated embodiment includes an outer surface 52 defining a substantially square shape, insulator 34 may have an outer surface 52 defining other suitable shapes, including generally rectangular, non-circular, or curvilinear (such as, e.g., circular) shapes.

In the exemplary embodiment of FIGS. 4-5, insulator 34 further includes a first insulative member 54 disposed within shield element 32 adjacent front end 36, and a second insulative member 56 disposed within shield element 32 adjacent back end 38. First and second insulative members 54, 56 are configured to provide structural support to insulator 34. In this embodiment, three spacer bars 58 are provided that properly position and space first and second insulative members 54, 56 with respect to each other. The first and second insulative members 54, 56 and three spacer bars 58 are shaped to receive an electrical contact 30 and are configured for slidable insertion into shield element 32, such that electrical contact 30 lies substantially parallel to a longitudinal axis of shield element 32. The first and second insulative members 54, 56 and three spacer bars 58 are configured to guide electrical contact 30 during its insertion into insulator 34. In this configuration, electrical cable termination 10 can serve as a coaxial cable termination, whereby electrical contact 30 can be connected, e.g., to a single coaxial cable.

In the exemplary embodiment of FIGS. 4-5 and as best shown in FIG. 4, front end 48 of insulator 34 is set back from front end 36 of shield element 32 and front end 70 of electrical contact 30. This arrangement defines second alignment element 16 of terminated cable assembly 6 and facilitates alignment of terminated cable assembly 6 in carrier 4. Front end 36 of shield element 32 defines an outer plane 33 of terminated cable assembly 6 that is intersected by corresponding first alignment element 12 of carrier 4 when carrier 4 and terminated cable assembly 6 are in an assembled configuration. In other embodiments, front end 48 of insulator 34 may be set back from at least one of front end 36 of shield element 32 and front end 70 of one or more electrical contacts 30.

In another embodiment, one or more spacer bars 58 are shaped to receive two electrical contacts 30 and are configured for slidable insertion into shield element 32, such that two electrical contacts 30 lie substantially parallel to a longitudinal axis of shield element 32. One or more spacer bars 58 are configured to guide two electrical contacts 30 during their insertion into insulator 34. In this configuration, electrical cable termination 10 can serve as a twinaxial cable termination, whereby two electrical contacts 30 can be connected, e.g., to a single twinaxial cable.

In other embodiments, insulator 34 may include two or more mating insulator parts (not shown). Each insulator part may be separately formed or may be integrally hinged in a clamshell fashion to facilitate injection molding or machining and to provide an ease of assembly of one or more electrical contacts 30. The two or more mating insulator parts can be assembled using any suitable method/structure, including but not limited to snap fit, friction fit, press fit, mechanical clamping, and adhesive. In one exemplary embodiment, insulator 34 may include two mating insulator parts, each insulator part extending longitudinally along the length of one or more electrical contacts 30. In another exemplary embodiment, insulator 34 may include two mating insulator parts, each insulator part, which may be hermaphroditic, encompassing substantially one-half the length of one or more electrical contacts 30.

In the embodiment illustrated in FIGS. 4-5, a spacer bar 58 of insulator 34 includes a laterally protruding positioning and latching element 60 that snaps into a mating opening 62 in shield element 32 to properly position and retain insulator 34 in shield element 32. As insulator 34 (containing one or more electrical contacts 30) is inserted into shield element 32, spacer bar 58 with positioning and latching element 60 deflects inwardly (toward the one or more electrical contacts 30) until engaging with mating opening 62 in shield element 32. Beneficially, if insulator 34 is improperly assembled into shield element 32 (i.e., such that positioning and latching element 60 is not aligned or engaged with opening 62), the presence of positioning and latching element 60 will cause shield element 32 to bulge such that electrical cable termination 10 will not fit in the retainer or organizer plate, thereby preventing the installation and use of an improperly assembled electrical cable termination 10. In other embodiments, the proper positioning and retaining of insulator 34 may be accomplished by separate elements. For example, insulator 34 may include one or more positioning elements configured to properly position insulator 34 in shield element 32 and/or one or more latching elements configured to properly retain insulator 34 in shield element 32.

In one embodiment, electrical cable termination 10 is configured for termination of an electrical cable 8, such that a conductor 64 of electrical cable 8 is attached to electrical contact 30 and ground shield 68 of electrical cable 8 is attached to shield element 32 of electrical cable termination 10 using conventional means, such as soldering. The type of electrical cable used in an aspect of the present invention can be a single wire cable (e.g., single coaxial or single twinaxial) or a multiple wire cable (e.g., multiple coaxial, multiple twinaxial, or twisted pair). In one embodiment, prior to attaching one or more electrical contacts 30 to one or more conductors 64 of electrical cable 8, ground shield 68 is stiffened by a solder dip process. After one or more electrical contacts 30 are attached to one or more conductors 64, the one or more electrical contacts 30 are slidably inserted into insulator 34. The prepared end of electrical cable 8 and insulator 34 are configured such that the stiffened ground shield 68 bears against back end 50 of insulator 34 prior to one or more electrical contacts 30 being fully seated against front end 48 of insulator 34. Thus, when insulator 34 (having one or more electrical contacts 30 therein) is next slidably inserted into shield element 32, the stiffened ground shield 68 acts to push insulator 34 into shield element 32, and one or more electrical contacts 30 are prevented from pushing against insulator 34 in the insertion direction. In this manner, one or more electrical contacts 30 are prevented from being pushed back into electrical cable 8 by reaction to force applied during insertion of insulator 34 into shield element 32, which may prevent proper connection of one or more electrical contacts 30 with header 400.

In one embodiment, electrical cable termination 10 includes two electrical contacts 30 and is configured for termination of an electrical cable 8 including two conductors 64. Each conductor 64 of electrical cable 8 is connected to an electrical contact 30 of electrical cable termination 10, and ground shield 68 of electrical cable 8 is attached to shield element 32 of electrical cable termination 10 using conventional means, such as soldering. The type of electrical cable used in this embodiment can be a single twinaxial cable.

In one embodiment, first and second insulative members 54, 56 and spacer bars 58 of insulator 34 are configured to provide an open path between the area of shield element 32 to be soldered to ground shield 68 and the area under latch member 44 of shield element 32, such that solder flux vapor may be vented during soldering.

In one aspect, some elements of terminated cable assembly 6 may be constructed in a manner the same as or similar to what is taught in U.S. Patent Application Publication No. 2008-0020615 A1, published Jan. 24, 2008.

Figure 6:
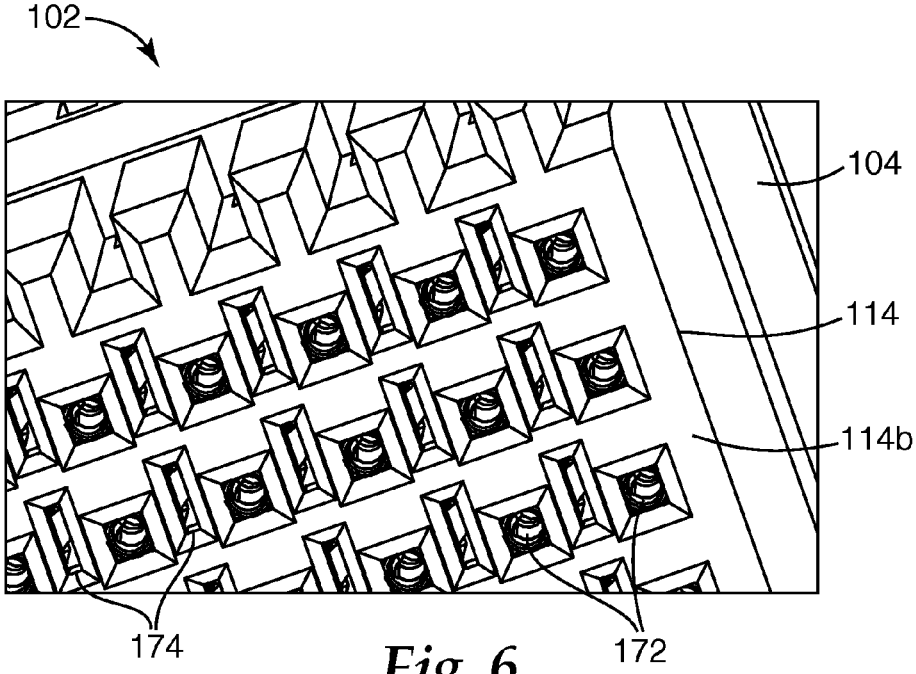
FIG. 6 is a detailed perspective view of another exemplary embodiment of an electrical connector assembly according to an aspect of the present invention.
Figure 7:
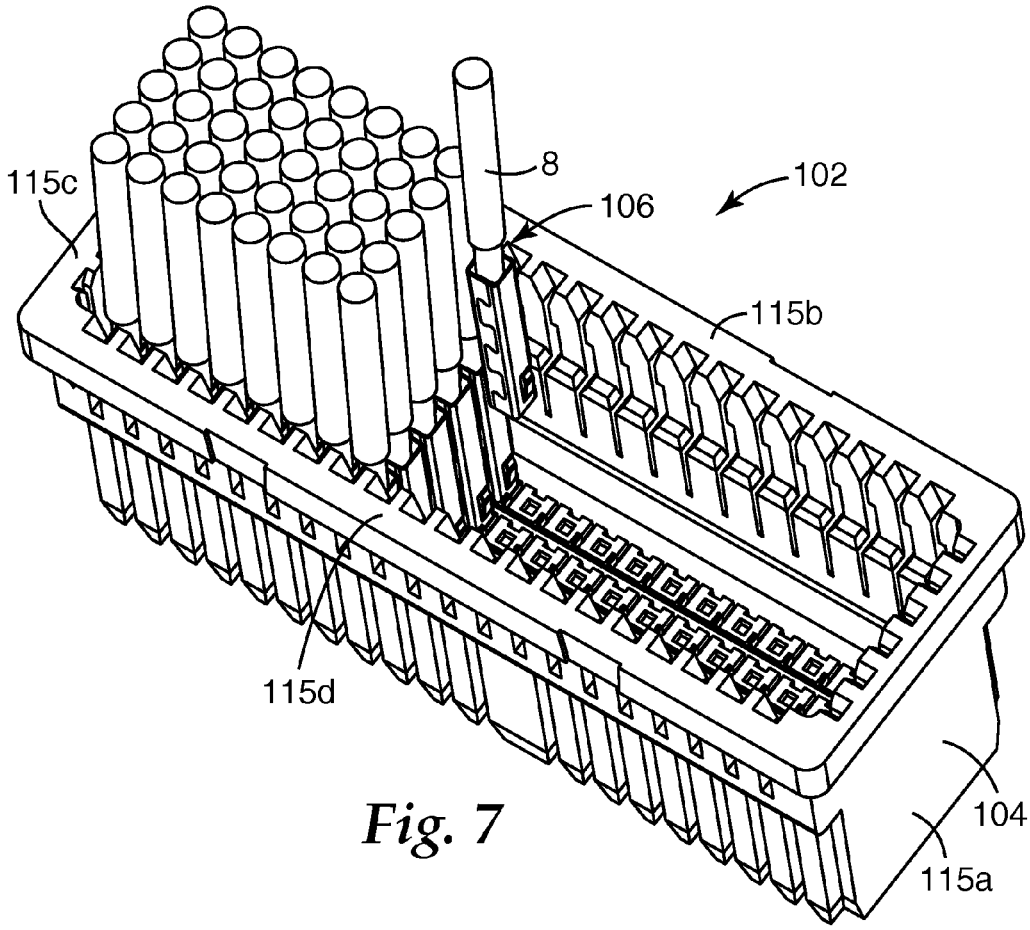
FIG. 7 is a perspective view of the electrical connector assembly of FIG. 6 in a partially assembled configuration.
Figure 9:
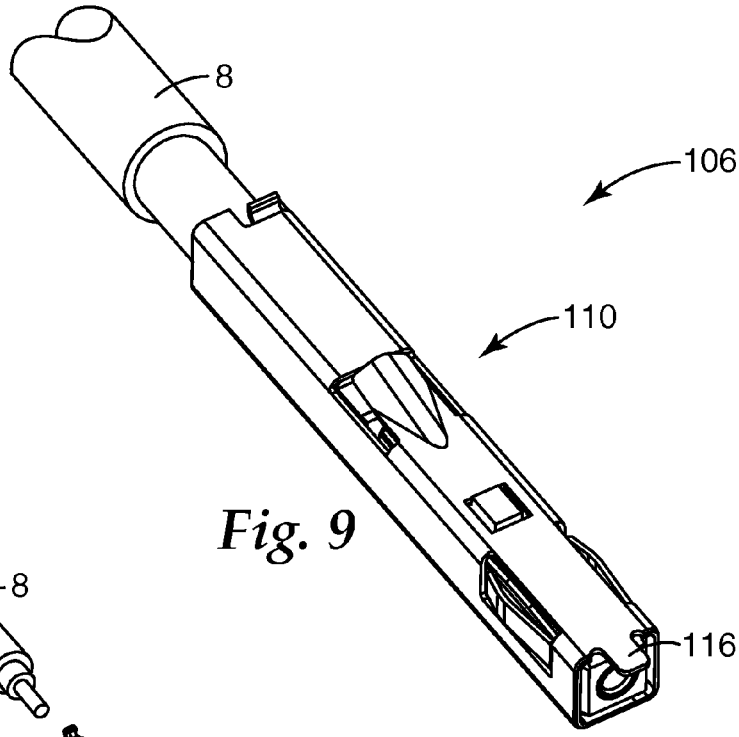
FIG. 9 is a perspective view of a terminated cable assembly that can be used in the electrical connector assembly of FIG. 6.

FIGS. 6-7 illustrate another exemplary embodiment of an electrical connector assembly according to an aspect of the present invention in a fully assembled and partially assembled configuration, respectively. Electrical connector assembly 102 includes a carrier 104 and a plurality of terminated cable assemblies 106 retained by carrier 104. As best shown in FIG. 9, terminated cable assemblies 106 include electrical cables 8 and electrical cable terminations 110. Electrical connector assembly 102 is configured to mate with header 400 (shown in FIG. 18) configured for mounting on a printed circuit board (not shown) to form an electrical connection between electrical cables 8 and the printed circuit board.

Referring to FIGS. 6-7, carrier 104 includes a generally planar front wall 114 having an internal surface 114*a* (shown in FIG. 8) and an external surface 114*b*. Carrier 104 further includes four side walls 115*a*-115*d* (collectively referred to herein as "side walls 115") extending from front wall 114. Front wall 114 is formed to include a plurality of contact pin receiving apertures 172 arranged in rows and columns. Between contact pin receiving apertures 172 are contact element receiving apertures 174, also arranged in rows and columns. Carrier 104 is configured to receive a retainer or organizer plate (not shown) and electrical cable terminations 110 on the side of internal surface 114*a*, and is further configured on its external surface 114*b* to guide an array of contact pins 406 of header 400 through front ends 136 of shield elements 132 of electrical cable terminations 110 to make electrical connection with electrical contacts 30 therein, and to guide an array of contact elements 408 of header 400 into electrical contact with ground contact beams 142 of shield elements 132.

Figure 8:
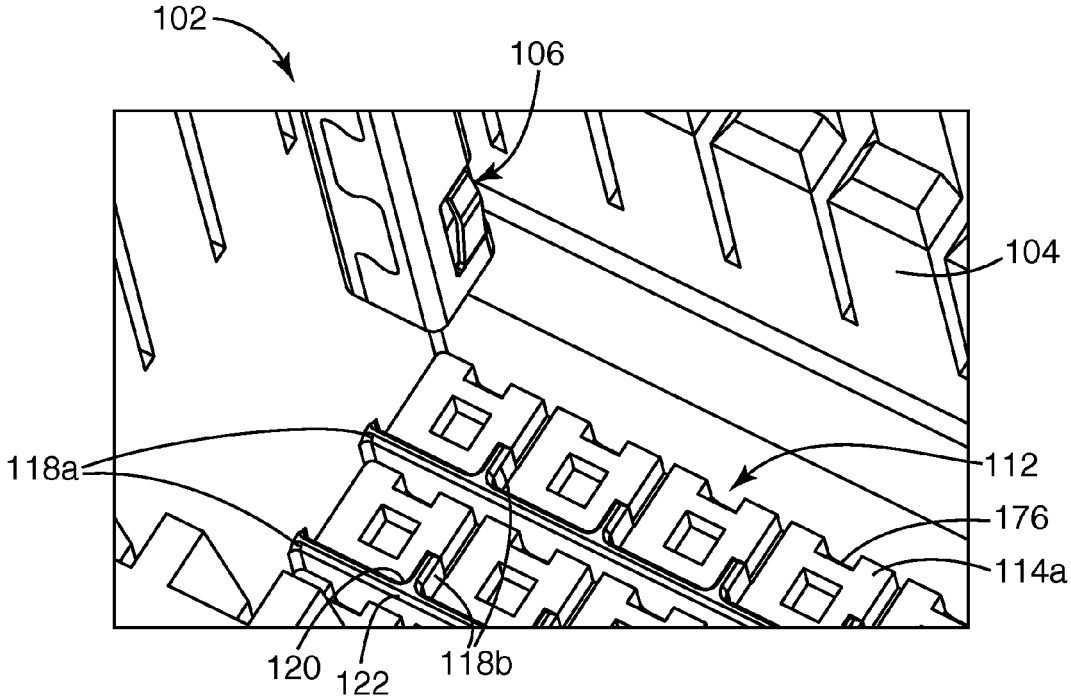
FIG. 8 is a detailed perspective view of the electrical connector assembly of FIG. 6 in a partially assembled configuration.

FIG. 8 illustrates a detail of electrical connector assembly 102 in a partially assembled configuration. In particular, it shows a detail of carrier 104 having a plurality of first alignment elements 112 and a terminated cable assembly 106 having a second alignment element 116 (shown in FIG. 9). First alignment elements 112 of carrier 104 and second alignment elements 116 of terminated cable assemblies 106 are configured to cooperatively align terminated cable assemblies 106 in carrier 104. In the exemplary embodiment of FIG. 8, first alignment elements 112 include a second alignment element receiving aperture 176, and at least a portion of longitudinal alignment ribs 118*a* extending along the length of carrier 104 and transverse alignment ribs 118*b* extending substantially perpendicular from longitudinal alignment ribs 118*a* or side wall 115*d*. Side walls 115*b* and 115*d* of carrier 104 are configured to assist in aligning the terminated cable assemblies 106 positioned adjacent side walls 115*b* and 115*d* respectively, thereby practically serving as longitudinal alignment ribs 118*a*. Similarly, side walls 115*a* and 115*c* of carrier 104 are configured to assist in aligning the terminated cable assemblies 106 positioned adjacent side walls 115*a* and 115*c* respectively, thereby practically serving as transverse alignment ribs 118*b*.

Longitudinal alignment ribs 118*a* and transverse alignment ribs 118*b* (collectively referred to herein as "alignment ribs 118") extend from an internal surface 114*a* of the carrier and define substantially square shaped alignment boxes. Longitudinal alignment ribs 118*a* may facilitate injection molding of carrier 104. Alignment ribs 118 may extend from internal surface 114*a* substantially perpendicularly. Optionally, alignment ribs 118 may have a slope to provide guidance during insertion of terminated cable assemblies 106 and injection molding of carrier 104. Alignment ribs 118 may additionally include side chamfers or radii 120 and/or top chamfers or radii 122 to provide guidance and positioning during insertion of terminated cable assemblies 106 into carrier 104 and facilitate injection molding of carrier 104. In other embodiments, alignment ribs 118 may define other suitable shapes, such as, e.g. other rectilinear shapes or curvilinear shapes.

Second alignment element receiving apertures 176 are positioned in internal surface 114*a* of carrier 104 and configured to receive second alignment elements 116 of terminated cable assemblies 106. Second alignment elements 116 intersect internal surface 114*a* of carrier 104 when carrier 104 and terminated cable assemblies 106 are in an assembled configuration.

Figure 10:
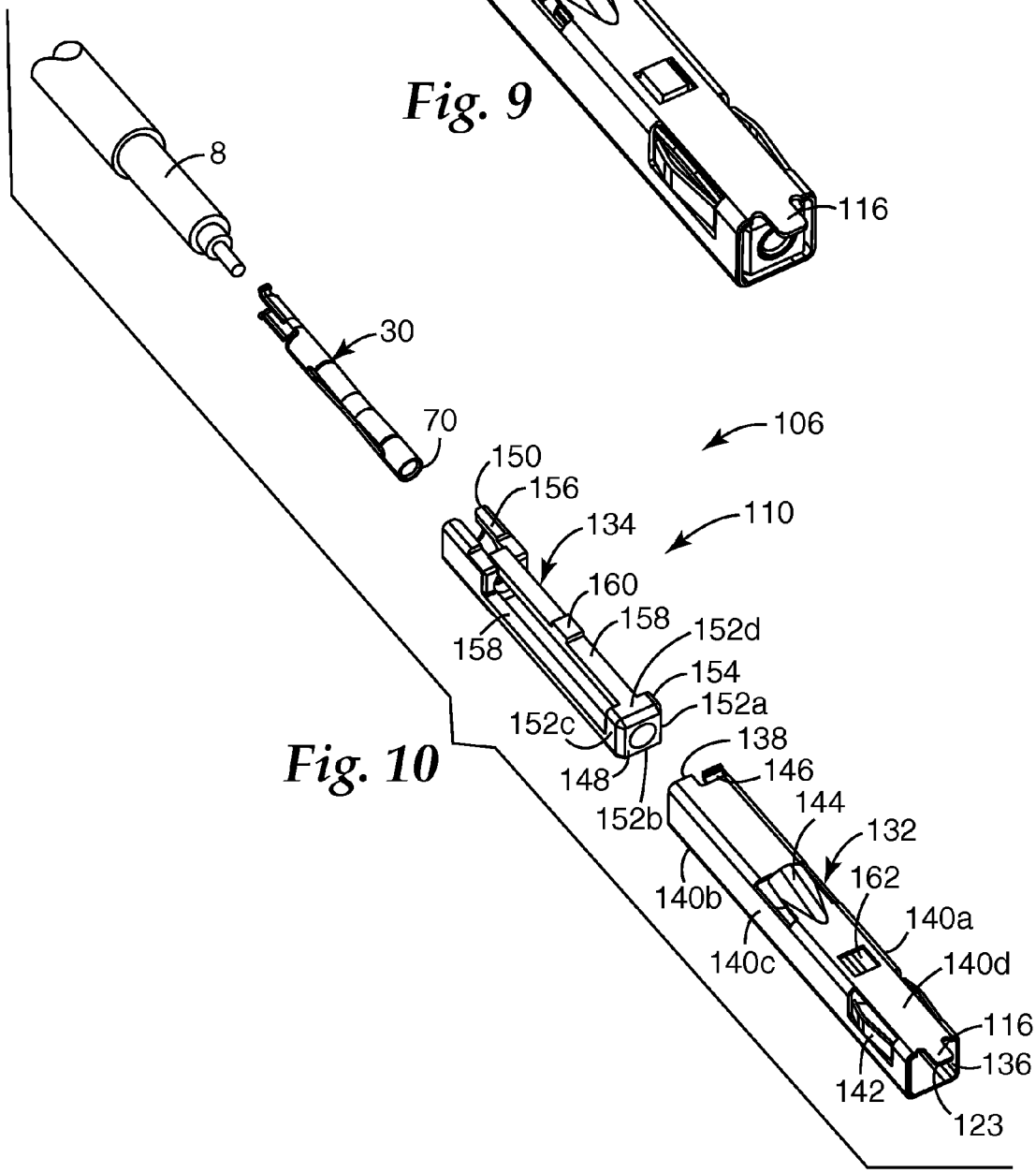
FIG. 10 is an exploded perspective view of the terminated cable assembly of FIG. 9.

FIGS. 9-10 illustrate an exemplary embodiment of a terminated cable assembly that can be used in the electrical connector assembly of FIGS. 6-8 and FIGS. 11-13. Terminated cable assembly 106 includes an electrical cable 8 and an electrical cable termination 110.

Electrical cable termination 110 includes a longitudinal electrically conductive shield element 132, an insulator 134, and a single electrical contact 30. Electrically conductive shield element 132 has a front end 136, a back end 138, and side surfaces 140*a*-140*d* (collectively referred to herein as "sides 140") defining a non-circular transverse cross-section.

As illustrated, shield element 132 includes laterally protruding resilient ground contact beams 142 disposed on opposed side surfaces 140*a* and 140*c*.

A latch member 144 extends from at least one of sides 140. The latch member is configured to retain electrical cable termination 110 in a retainer or organizer plate (not shown) configured to receive, secure, and manage a plurality of electrical cable terminations.

Shield element 132 includes a second alignment element 116, such as, e.g., a tab, configured to be received by corresponding second alignment element receiving aperture 176 of carrier 104 (shown in FIG. 8) or a portion of corresponding pin insertion aperture 272 of carrier 204 (shown in FIG. 13) to cooperatively align terminated cable assembly 106 in carrier 104 or carrier 204 respectively. As illustrated, a single second alignment element 116 in the form of a tab extends from front end 136 of shield element 132 and is integrally formed with shield element 132. In other embodiments, one or more second alignment elements 116 may extend from an outer surface of terminated cable assembly 106. For example, in the embodiment of FIGS. 9-10, one or more second alignment elements 116 may extend from sides 140 of shield element 132, the surface defined by front end 136 of shield element 132 and front end 148 of insulator 134 (described below). One or more second alignment elements 116 may be integrally formed with or separately attached to elements of electrical cable termination 110, such as, e.g., shield element 132, electrical contact 30, or insulator 134. In the exemplary embodiment of FIGS. 9-10, a single second alignment element 116 is integrally formed with shield element 132. Second alignment elements 116 may additionally include chamfers or radii 123 to provide guidance and positioning during insertion of terminated cable assemblies 106 into carrier 104 or carrier 204.

Shield element 132 may further include a keying member, in the form of tab 146, laterally extending from back end 138 of shield element 132. Tab 146 is configured to ensure that electrical cable termination 110 is inserted into the retainer or organizer plate in the correct predetermined orientation. If electrical cable termination 110 is not properly oriented within the retainer or organizer plate, electrical cable termination 110 cannot be fully inserted.

Although the figures show that shield element 132 includes ground contact beams 142, it is within the scope of the present invention to use other contact element configurations, such as Hertzian bumps, in place of contact beams 142.

Insulator 134 has a front end 148, a back end 150, and outer surfaces 152*a*-152*d* (collectively referred to herein as "outer surface 152") defining a non-circular shape.

In the exemplary embodiment of FIGS. 9-10, insulator 134 further includes a first insulative member 154 disposed within shield element 132 adjacent front end 136, and a second insulative member 156 disposed within shield element 132 adjacent back end 138. First and second insulative members 154, 156 are configured to provide structural support to insulator 134. In this embodiment, three spacer bars 158 are provided that properly position and space first and second insulative members 154, 156 with respect to each other. The first and second insulative members 154, 156 and three spacer bars 158 are shaped to receive an electrical contact 30 and are configured for slidable insertion into shield element 132, such that electrical contact 30 lies substantially parallel to a longitudinal axis of shield element 132. The first and second insulative members 154, 156 and three spacer bars 158 are configured to guide electrical contact 30 during its insertion into insulator 134. In this configuration, electrical cable termination 110 can serve as a coaxial cable termination, whereby electrical contact 30 can be connected, e.g., to a single coaxial cable.

In the exemplary embodiment of FIGS. 9-10 and as best shown in FIG. 9, front end 148 of insulator 134 is substantially coplanar with front end 136 of shield element 132 and front end 70 of electrical contact 30. This arrangement allows terminated cable assembly 106 to be inserted in carrier 104 such that front end 148 of insulator 134, front end 136 of shield element 132, and front end 70 of electrical contact 30 abut internal surface 114*a* of front wall 114 of carrier 104 while facilitating alignment of terminated cable assembly 106 in carrier 104 by first alignment elements 112 and second alignment elements 116.

In other embodiments, front end 70 of one or more electrical contacts 30 may be set back from or set forward of front end 136 of shield element 132. One advantage of setting front end 70 of electrical contact 30 back from front end 136 of shield element 132 is that front end 148 of insulator 134, as opposed to front end 70 of electrical contact 30, may provide the initial guidance of contact pin 406 of header 400 into electrical contact 30. Because front end 148 of insulator 134 has a larger contact pin entry area than front end 70 of electrical contact 30, additional guidance of contact pin 406 during insertion into electrical cable termination 110 is then provided.

One advantage of setting front end 70 of electrical contact 30 forward of front end 136 of shield element 132 is that front end 70 of electrical contact 30, cooperating with a corresponding recess (not shown) in internal surface 114*a* of carrier 104, may guide and position electrical contact 30 independent of the guidance and positioning of terminated cable assembly 106 into carrier 104. Independent guidance and positioning of electrical contact 30 reduces tolerance stack-ups in the assembly and provides a more precise placement of electrical contact 30 in carrier 104. Another advantage of setting front end 70 of electrical contact 30 forward of front end 136 of shield element 132 is that a protective collar or spacer (not shown) may be placed around front end 70 of electrical contact 30, e.g., to protect front end 136 of shield element 132 and front end 148 of insulator 134 against damage.

In the embodiment illustrated in FIGS. 9-10, a spacer bar 158 of insulator 134 includes a laterally protruding positioning and latching element 160 that snaps into a mating opening 162 in shield element 132 to properly position and retain insulator 134 in shield element 132. As insulator 134 (containing one or more electrical contacts 30) is inserted into shield element 132, spacer bar 158 with positioning and latching element 160 deflects inwardly (toward the one or more electrical contacts 30) until engaging with mating opening 162 in shield element 132. Beneficially, if insulator 134 is improperly assembled into shield element 132 (i.e., such that positioning and latching element 160 is not aligned or engaged with opening 162), the presence of positioning and latching element 160 will cause shield element 132 to bulge such that electrical cable termination 110 will not fit in the retainer or organizer plate, thereby preventing the installation and use of an improperly assembled electrical cable termination 110.

Figure 11:
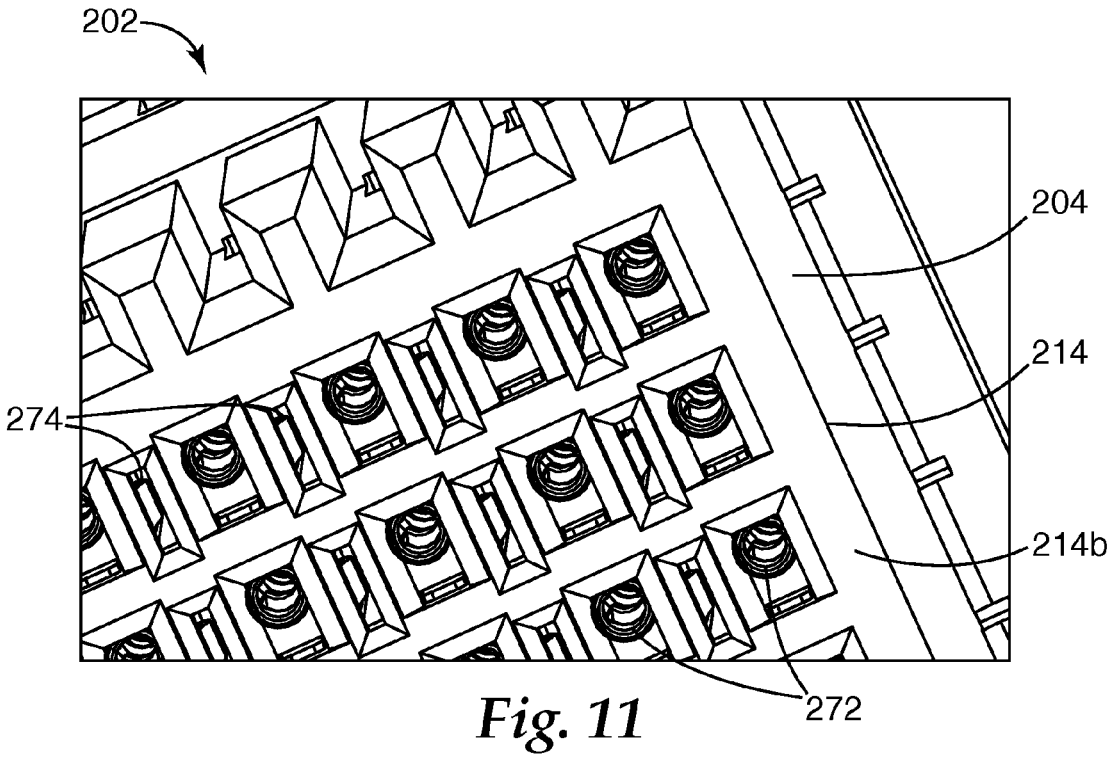
FIG. 11 is a detailed perspective view of another exemplary embodiment of an electrical connector assembly according to an aspect of the present invention.
Figure 12:
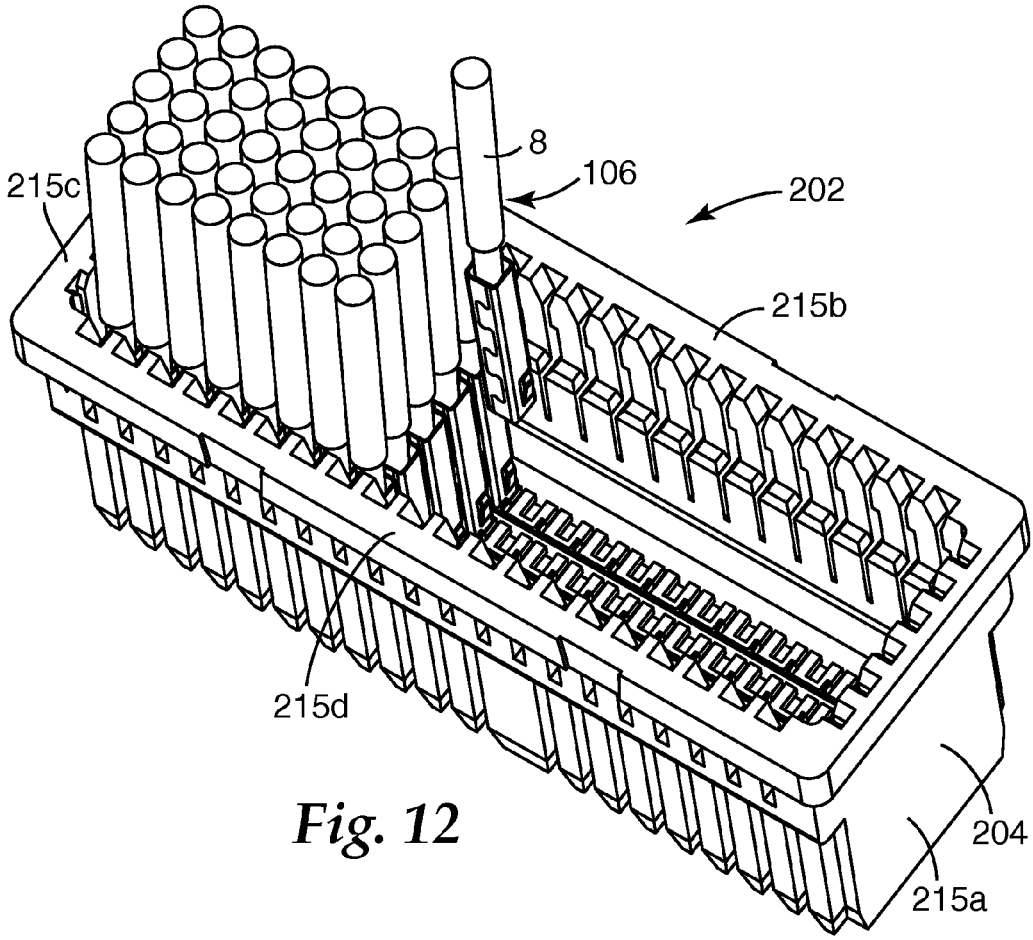
FIG. 12 is a perspective view of the electrical connector assembly of FIG. 11 in a partially assembled configuration.

FIGS. 11-12 illustrate another exemplary embodiment of an electrical connector assembly according to an aspect of the present invention in a fully assembled and partially assembled configuration, respectively. Electrical connector assembly 202 includes a carrier 204 and a plurality of terminated cable assemblies 106 (shown in FIGS. 9-10 and described above) retained by carrier 204. Terminated cable assemblies 106 include electrical cables 8 and electrical cable terminations 110. Electrical connector assembly 202 is configured to mate with header 400 configured for mounting on a printed circuit board (not shown) to form an electrical connection between electrical cables 8 and the printed circuit board.

Referring to FIG. 11-12, carrier 204 includes a generally planar front wall 214 having an internal surface 214*a* (shown in FIG. 13) and an external surface 214*b*. Carrier 204 further includes four side walls 215*a*-215*d* (collectively referred to herein as "side walls 215") extending from front wall 214. Front wall 214 is formed to include a plurality of contact pin receiving apertures 272 arranged in rows and columns. Between contact pin receiving apertures 272 are contact element receiving apertures 274, also arranged in rows and columns. Carrier 204 is configured to receive a retainer or organizer plate (not shown) and electrical cable terminations 110 on the side of internal surface 214*a*, and is further configured on its external surface 214*b* to guide an array of contact pins 406 of header 400 through front ends 136 of shield elements 132 of electrical cable terminations 110 to make electrical connection with electrical contacts 30 therein, and to guide an array of contact elements 408 of header 400 into electrical contact with ground contact beams 142 of shield elements 132.

Figure 13:
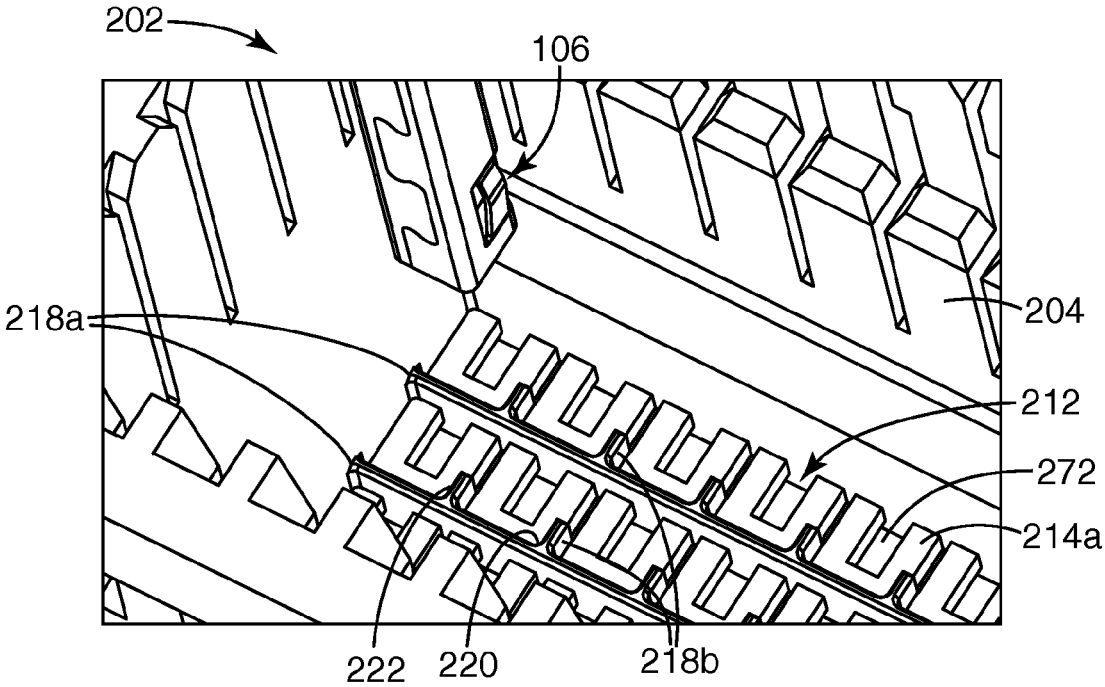
FIG. 13 is a detailed perspective view of the electrical connector assembly of FIG. 11 in a partially assembled configuration.

FIG. 13 illustrates a detail of electrical connector assembly 202 in a partially assembled configuration. In particular, it shows a detail of carrier 204 having a plurality of first alignment elements 212 and a terminated cable assembly 106 having a second alignment element 116 (shown in FIG. 9). First alignment elements 212 of carrier 204 and second alignment elements 116 of terminated cable assemblies 106 are configured to cooperatively align terminated cable assemblies 106 in carrier 204.

In the exemplary embodiment of FIG. 13, first alignment elements 212 include contact pin receiving aperture 272, and at least a portion of longitudinal alignment ribs 218*a* extending along the length of carrier 204 and transverse alignment ribs 218*b* extending substantially perpendicular from longitudinal alignment ribs 218*a* or side wall 215*d*. Side walls 215*b* and 215*d* of carrier 204 are configured to assist in aligning the terminated cable assemblies 106 positioned adjacent side walls 215*b* and 215*d* respectively, thereby practically serving as longitudinal alignment ribs 218*a*. Similarly, side walls 215*a* and 215*c* of carrier 204 are configured to assist in aligning the terminated cable assemblies 106 positioned adjacent side walls 215*a* and 215*c* respectively, thereby practically serving as transverse alignment ribs 218*b*.

Compared with having a separate second alignment element receiving aperture 176 (as shown in FIG. 8), including contact pin receiving aperture 272 in first alignment elements 212 provides a more robust design of contact pin receiving aperture 272 and corresponding first alignment element 212 and of the injection mold core that may be used to form these elements. In this embodiment, a contact pin 406 of header 400 is supported by three of the four side walls of contact pin receiving aperture 272.

In other embodiments, first alignment elements 212 may include a portion of contact pin receiving aperture 272. Compared with having a separate second alignment element receiving aperture 176 (as shown in FIG. 8), including a portion of contact pin receiving aperture 272 in first alignment elements 212 provides a more robust design of contact pin receiving aperture 272 and corresponding first alignment element 212 and of the injection mold core that may be used to form these elements, while allowing for the geometry of contact pin receiving aperture 272 on the side of external surface 214*b* of carrier 204 to be substantially identical to the geometry of contact pin receiving aperture 172 on the side of external surface 114*b* of carrier 104 (as shown in FIG. 6). This preservation of geometry benefits the guidance of a contact pin 406 of header 400, because contact pin 406 is supported by all four side walls of contact pin receiving aperture 172.

Longitudinal alignment ribs 218*a* and transverse alignment ribs 218*b* (collectively referred to herein as "alignment ribs 218") extend from an internal surface 214*a* of the carrier and define substantially square shaped alignment boxes. Longitudinal alignment ribs 218*a* may facilitate injection molding of carrier 204. Alignment ribs 218 may extend from internal surface 214*a* substantially perpendicularly or may have a slope to provide guidance during insertion of terminated cable assemblies 106 and injection molding of carrier 204. Alignment ribs 218 may additionally include side chamfers or radii 220 and/or top chamfers or radii 222 to provide guidance and positioning during insertion of terminated cable assemblies 106 into carrier 204 and facilitate injection molding of carrier 204.

First alignment elements 212 including a portion of contact pin receiving aperture 272 are positioned in internal surface 214*a* of carrier 204 and configured to receive second alignment elements 116 of terminated cable assemblies 106. Second alignment elements 116 intersect internal surface 214*a* of carrier 204 and are positioned in corresponding contact pin receiving apertures 272 when carrier 204 and terminated cable assemblies 106 are in an assembled configuration.

Figure 14:
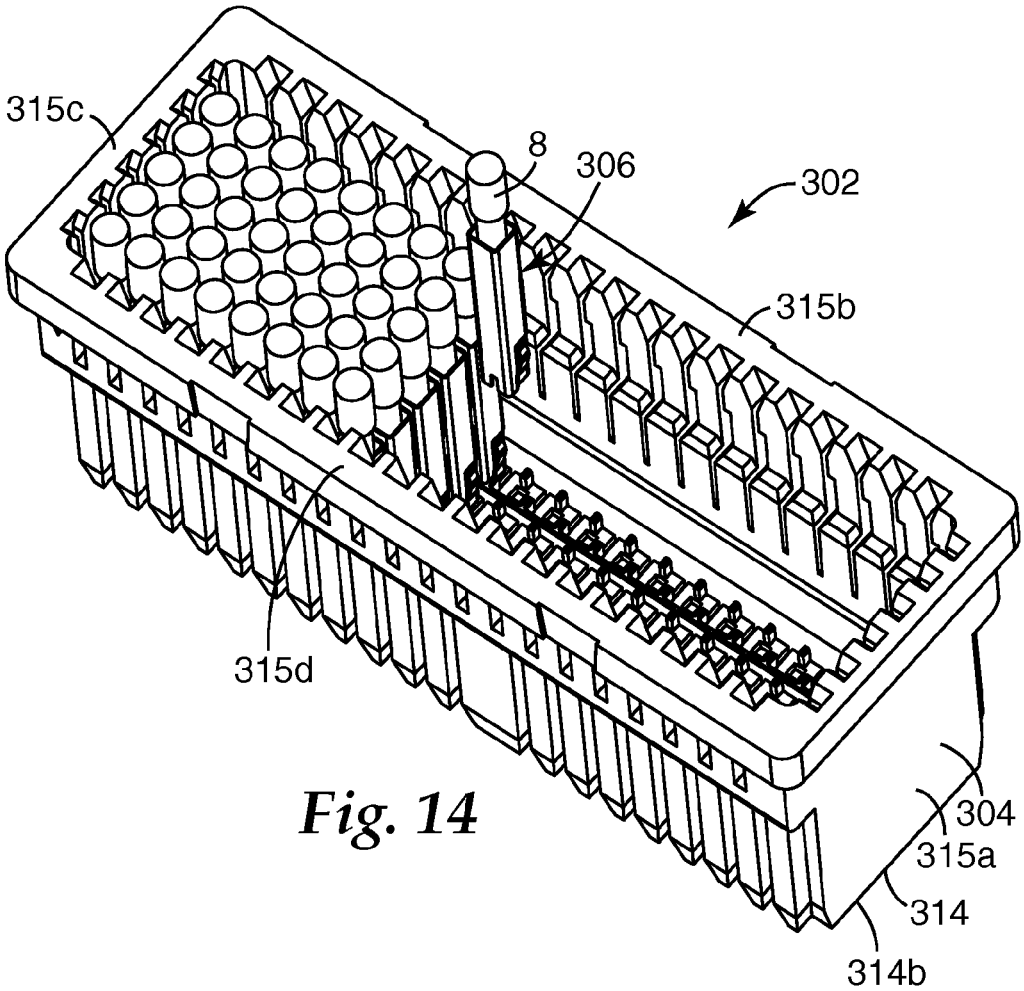
FIG. 14 is a perspective view of another exemplary embodiment of an electrical connector assembly according to an aspect of the present invention in a partially assembled configuration.
Figure 16:
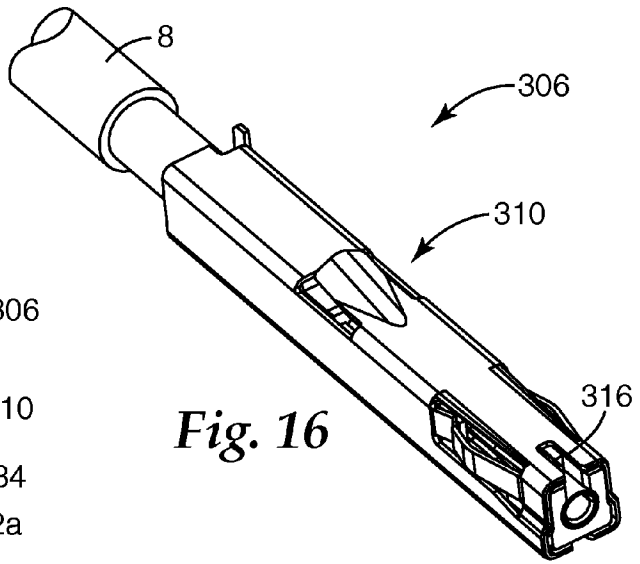
FIG. 16 is a perspective view of a terminated cable assembly that can be used in the electrical connector assembly of FIG. 14.

FIG. 14 illustrates another exemplary embodiment of an electrical connector assembly according to an aspect of the present invention in a partially assembled configuration. Electrical connector assembly 302 includes a carrier 304 and a plurality of terminated cable assemblies 306 retained by carrier 304. As best shown in FIG. 16, terminated cable assemblies 306 include electrical cables 8 and electrical cable terminations 310. Electrical connector assembly 302 is configured to mate with header 400 configured for mounting on a printed circuit board (not shown) to form an electrical connection between electrical cables 8 and the printed circuit board.

Referring to FIG. 14, carrier 304 includes a generally planar front wall 314 having an internal surface 314*a* (shown in FIG. 15) and an external surface 314*b*. Carrier 304 further includes four side walls 315*a*-315*d* (collectively referred to herein as "side walls 315") extending from front wall 314. Front wall 314 is formed to include a plurality of contact pin receiving apertures 372 arranged in rows and columns. Between contact pin receiving apertures 372 are contact element receiving apertures 374, also arranged in rows and columns. Carrier 304 is configured to receive a retainer or organizer plate (not shown) and electrical cable terminations 310 on the side of internal surface 314*a*, and is further configured on its external surface 314*b* to guide an array of contact pins 406 of header 400 through front ends 336 of shield elements 332 of electrical cable terminations 310 to make electrical connection with electrical contacts 30 therein, and to guide an array of contact elements 408 of header 400 into electrical contact with ground contact beams 342 of shield elements 332.

Figure 15:
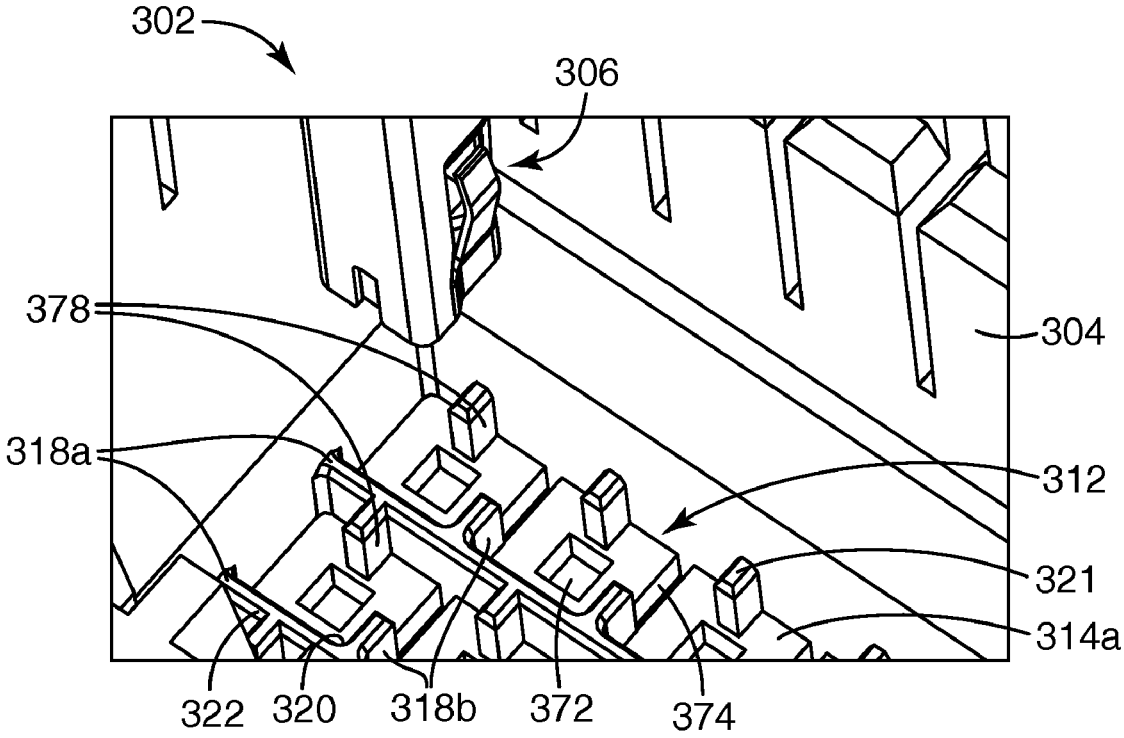
FIG. 15 is a detailed perspective view of the electrical connector assembly of FIG. 14 in a partially assembled configuration.

FIG. 15 illustrates a detail of electrical connector assembly 302 in a partially assembled configuration. In particular, it shows a detail of carrier 304 having a plurality of first alignment elements 312 and a terminated cable assembly 306 having a second alignment element 316 (shown in FIG. 16). First alignment elements 312 of carrier 304 and second alignment elements 316 of terminated cable assemblies 306 are configured to cooperatively align terminated cable assemblies 306 in carrier 304.

In the exemplary embodiment of FIG. 15, first alignment elements 312 include an alignment tab 378, and at least a portion of longitudinal alignment ribs 318*a* extending along the length of carrier 304 and transverse alignment ribs 318*b* extending substantially perpendicular from longitudinal alignment ribs 318*a* or side wall 315*d*. Side walls 315*b* and 315*d* of carrier 304 are configured to assist in aligning the terminated cable assemblies 306 positioned adjacent side walls 315*b* and 315*d* respectively, thereby practically serving as longitudinal alignment ribs 318*a*. Similarly, side walls 315*a* and 315*c* of carrier 304 are configured to assist in aligning the terminated cable assemblies 306 positioned adjacent side walls 315*a* and 315*c* respectively, thereby practically serving as transverse alignment ribs 318*b*.

Longitudinal alignment ribs 318*a* and transverse alignment ribs 318*b* (collectively referred to herein as "alignment ribs 318") extend from an internal surface 314*a* of the carrier and define substantially square shaped alignment boxes. Longitudinal alignment ribs 318*a* may facilitate injection molding of carrier 304. Alignment ribs 318 may extend from internal surface 314*a* substantially perpendicularly or may have a slope to provide guidance during insertion of terminated cable assemblies 306 and injection molding of carrier 304. Alignment ribs 318 may additionally include side chamfers or radii 320 and/or top chamfers or radii 322 to provide guidance and positioning during insertion of terminated cable assemblies 306 into carrier 304 and facilitate injection molding of carrier 304.

Alignment tabs 378 extend substantially perpendicular from longitudinal alignment ribs 318*a* or side wall 315*b*, and extend from internal surface 314*a* of the carrier. Alignment tabs 378 may extend from internal surface 314*a* substantially perpendicularly or may have a slope to provide guidance during insertion of terminated cable assemblies 306 and injection molding of carrier 304. Alignment tabs 378 may additionally include top chamfers or radii 321 to provide guidance and positioning during insertion of terminated cable assemblies 306 into carrier 304 and injection molding of carrier 304. In one embodiment, alignment tabs 378 are positioned offset from transverse alignment ribs 318*b* to help reduce lateral and rotational movement of terminated cable assemblies 306 in an assembled configuration.

Figure 17:
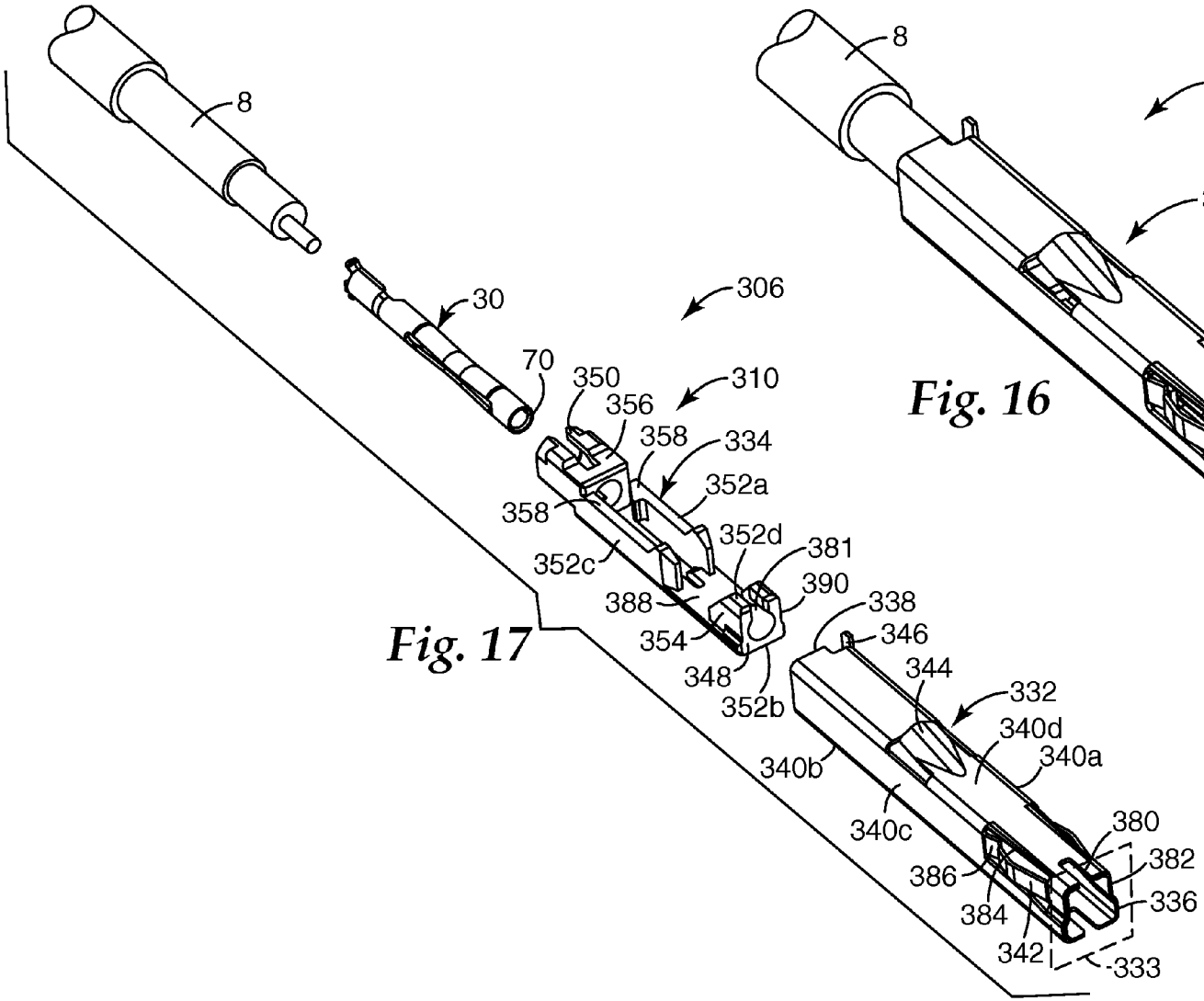
FIG. 17 is an exploded perspective view of the terminated cable assembly of FIG. 16.

FIGS. 16-17 illustrate an exemplary embodiment of a terminated cable assembly that can be used in the electrical connector assembly of FIGS. 14-15. Terminated cable assembly 306 includes an electrical cable 8 and an electrical cable termination 310.

Electrical cable termination 310 includes a longitudinal electrically conductive shield element 332, an insulator 334, and a single electrical contact 30. Electrically conductive shield element 332 has a front end 336, a back end 338, and side surfaces 340*a*-340*d* (collectively referred to herein as "sides 340") defining a non-circular transverse cross-section.

As illustrated, shield element 332 includes laterally protruding resilient ground contact beams 342 disposed on opposed side surfaces 340*a* and 340*c*.

A latch member 344 extends from at least one of sides 340. The latch member is configured to retain electrical cable termination 310 in a retainer or organizer plate (not shown) configured to receive, secure, and manage a plurality of electrical cable terminations.

Shield element 332 includes alignment apertures 380 positioned in opposed side surfaces 340*b* and 340*d* and configured to receive at least a portion of an alignment tab 378 of carrier 304 (shown in FIG. 15) to cooperatively align terminated cable assembly 306 in carrier 304. Shield element 332 may include a single alignment aperture 380, or it may include two or more alignment apertures 380 having a different size, shape, and/or non-symmetric placement on shield element 332, whereby alignment tabs 378 may be configured to cooperate with the two or more alignment apertures 380 to ensure that electrical cable termination 310 is inserted into carrier 304 in the correct predetermined orientation.

In the illustrated embodiment, the arrangement of alignment aperture 380 positioned in side surface 340*d* of shield element 332 and alignment aperture 381 of insulator 334 (described below) define second alignment element 316 of terminated cable assembly 306 and facilitates alignment of terminated cable assembly 306 in carrier 304. Front end 336 of shield element 332 defines an outer plane 333 of terminated cable assembly 306 that is intersected by corresponding first alignment element 312 of carrier 304 when carrier 304 and terminated cable assembly 306 are in an assembled configuration. In other embodiments, second alignment element 316 may be defined by one of alignment aperture 380 of shield element 332 or alignment aperture 381 of insulator 334.

Shield element 332 may further include a keying member, in the form of tab 346, laterally extending from back end 338 of shield element 332. Tab 346 is configured to ensure that electrical cable termination 310 is inserted into the retainer or organizer plate in the correct predetermined orientation. If electrical cable termination 310 is not properly oriented within the retainer or organizer plate, electrical cable termination 310 cannot be fully inserted.

Although the figures show that shield element 332 includes ground contact beams 342, it is within the scope of the present invention to use other contact element configurations, such as Hertzian bumps, in place of contact beams 342.

Shield element 332 includes recesses 382, in the form of narrowed portions, disposed on opposed side surfaces 340*a* and 340*c*. Recesses 382 facilitate insertion of contact elements 408 of header 400. To further facilitate insertion of contact elements 408, shield element 332 includes contact element deflecting rails 384 and contact element deflecting tabs 386 disposed on opposed side surfaces 340*a* and 340*c*. While recesses 382 provide additional clearance for contact elements 408, deflecting rails 384 and deflecting tabs 386 eliminate any opportunity for contact elements 408 to stub onto shield element 332 during insertion by guiding contact elements 408 away from shield element 332. When electrical connector assembly 302 and header 400 are in a mated configuration, a portion of contact elements 408 of header 400 is positioned in the corresponding recess 382 of shield element 332 while making electrical contact with corresponding contact beam 342. In other embodiments, at least a portion of shield element 332 may be recessed as described above or in other suitable ways to facilitate insertion of a contact element 408 of header 400. For example, shield element 332 may include a single recess 382 disposed on one of sides 340. Shield element 332 may include one or both of at least one contact element deflecting rail 384 and at least one contact element deflecting tab 386.

Insulator 334 has a front end 348, a back end 350, and outer surfaces 352*a*-352*d* (collectively referred to herein as "outer surface 352") defining a non-circular shape.

In the exemplary embodiment of FIGS. 16-17, insulator 334 further includes a first insulative member 354 disposed within shield element 332 adjacent front end 336, and a second insulative member 356 disposed within shield element 332 adjacent back end 338. First and second insulative members 354, 356 are configured to provide structural support to insulator 334. In this embodiment, two spacer bars 358 and a bridge portion 388 are provided that properly position and space first and second insulative members 354, 356 with respect to each other. The first and second insulative members 354, 356, spacer bars 358, and bridge portion 388 are shaped to receive an electrical contact 30 and are configured for slidable insertion into shield element 332, such that electrical contact 30 lies substantially parallel to a longitudinal axis of shield element 332. The first and second insulative members 354, 356, and spacer bars 358 are configured to guide electrical contact 30 during its insertion into insulator 334. Bridge portion 388 is configured to connect first insulative member 354 to spacer bars 358 and provide clearance for contact beams 342. In this configuration, electrical cable termination 310 can serve as a coaxial cable termination, whereby electrical contact 30 can be connected, e.g., to a single coaxial cable.

Insulator 334 includes recesses 390, in the form of narrowed portions, disposed on opposed outer surfaces 352*a* and 352*c*. Recesses 390 facilitate insertion of insulator 334 into shield element 332 in the correct predetermined orientation. Beneficially, if insulator 334 is improperly assembled into shield element 332 (i.e., such that recesses 390 of insulator 334 and recesses 382 of shield element 332 are not aligned), insulator 334 cannot be fully installed (i.e., such that front end 348 of insulator 334 is substantially coplanar with front end 336 of shield element 332), thereby preventing the installation and use of an improperly assembled electrical cable termination 110. In other embodiments, at least a portion of insulator 334 may be recessed as described above or in other suitable ways to facilitate insertion of insulator 334 into shield element 332 in the correct predetermined orientation. For example, insulator 334 may include a single recess 390 disposed on outer surface 352.

Insulator 334 includes an alignment aperture 381 positioned in outer surface 352*d* and configured to receive at least a portion of an alignment tab 378 of carrier 304 (shown in FIG. 15) to cooperatively align terminated cable assembly 306 in carrier 304. Insulator 334 may include two or more alignment apertures 381 having the same or a different size, shape, and/or placement on insulator 334, whereby alignment tabs 378 may be configured to cooperate with the two or more alignment apertures 381 to ensure that electrical cable termination 310 is inserted into carrier 304 in the correct predetermined orientation.

In the exemplary embodiment of FIGS. 16-17 and as best shown in FIG. 16, front end 348 of insulator 334 is substantially coplanar with front end 336 of shield element 332 and front end 70 of electrical contact 30. This arrangement allows terminated cable assembly 306 to be inserted in carrier 304 such that front end 348 of insulator 334, front end 336 of shield element 332, and front end 70 of electrical contact 30 abut internal surface 314*a* of front wall 314 of carrier 304 while facilitating alignment of terminated cable assembly 306 in carrier 304 by first alignment elements 312 and second alignment elements 316.

In each of the embodiments and implementations described herein, one or both of the first and second alignment elements may be configured to guide and position the plurality of terminated cable assemblies in the carrier. For example, the first alignment elements may include various elements described herein, such as, e.g., opening 28, alignment ribs 118 and side chamfers or radii 120 and/or top chamfers or radii 122 thereof, second alignment element receiving aperture 176, and alignment tab 378 and top chamfers or radii 321 thereof, to name a few, to guide and position the terminated cable assemblies in the carrier. Also for example, the second alignment elements may include various elements described herein, such as, e.g., electrical contacts 30, second alignment elements 116 and/or chamfers or radii 123 thereof, and alignment apertures 380 and 381, to name a few, to guide and position the terminated cable assemblies in the carrier.

In each of the embodiments and implementations described herein, the first and second alignment elements, at least a portion of the carrier, and at least a portion of the terminated cable assemblies may be cooperatively configured in an impedance controlling relationship. An impedance controlling relationship means that the first and second alignment elements, at least a portion of the carrier, and at least a portion of the terminated cable assemblies may be cooperatively configured to control the characteristic impedance of the electrical connector assembly. For example, referring to the embodiment illustrated in FIGS. 1-5, to facilitate alignment of terminated cable assembly 6 in carrier 4, front end 48 of insulator 34 is set back from front end 36 of shield element 32 and front end 70 of electrical contact 30. This arrangement, defining second alignment element 16 of terminated cable assembly 6, changes the effective dielectric constant, and thereby the characteristic impedance of the assembly, in this area. The change in effective dielectric constant as a result of setting back front end 48 of insulator 34 from front end 36 of shield element 32 and front end 70 of electrical contact 30 can be countered by adjusting the design of first alignment elements 12, e.g., by changes in geometry, material, and/or location, to bring the characteristic impedance of electrical connector assembly 2 closer to the desired target value, such as, for example, 50 ohms.

Figure 18:
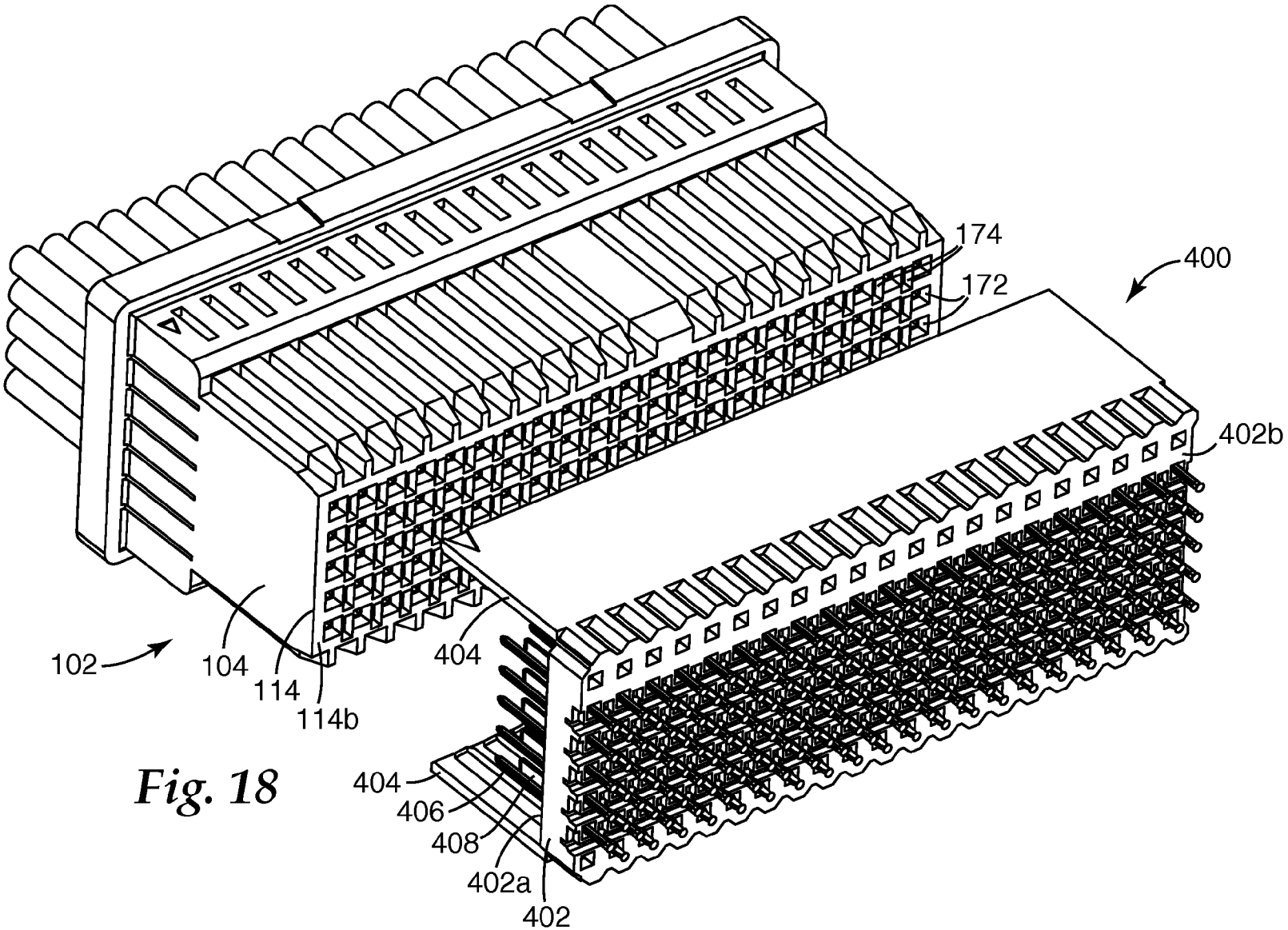
FIG. 18 is an exploded perspective view of an electrical connector system according to an aspect of the present invention.

Referring to FIG. 18, an exemplary embodiment of a header 400 that can be used in the present invention is illustrated. Header 400 includes a vertical front wall 402 having interior surface 402*a* and exterior surface 402*b*, and laterally extending side walls 404. Vertical front wall 402 is formed to include a plurality of contact pin insertion windows for contact pins 406 and a plurality of contact element insertion windows for contact elements 408, where the contact pins 406 and contact elements 408 extend through front wall 402. In use, header 400 is mated with an electrical connector assembly according to an aspect of the present invention. For example, in use, header 400 is mated with electrical connector assembly 102 such that interior surface 402*a* of header 400 is in contact with external surface 114*b* of front wall 114 of carrier 104 so that contact pins 406 and contact elements 408 slide through contact pin receiving apertures 172 and contact element receiving apertures 174, respectively, to mate with electrical contacts 30 and ground contact beams 142, respectively, of electrical cable terminations 110 (see FIG. 10). Another exemplary header that can be used in the present invention is disclosed in U.S. Pat. No. 6,146,202.

In each of the embodiments and implementations described herein, the various components of the electrical connector assembly and elements thereof are formed of any suitable material. The materials are selected depending upon the intended application and may include both metals and non-metals (e.g., any one or combination of non-conductive materials including but not limited to polymers, glass, and ceramics). In one embodiment, carrier 4 and insulator 34 are formed of a polymeric material by methods such as injection molding, extrusion, casting, machining, and the like, while the electrically conductive components are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector assembly comprising:

a carrier comprising a front wall and a plurality of first alignment elements disposed at the front wall, the front wall configured to receive a plurality of contact pins of a mating header; and a plurality of discrete terminated cable assemblies retained by the carrier, each terminated cable assembly comprising a front end and one or more second alignment elements disposed at the front end, the front end configured to receive a contact pin of a mating header, wherein the first and second alignment elements are configured to cooperatively align the plurality of terminated cable assemblies in the carrier.

2. The electrical connector assembly of claim 1, wherein the carrier further comprises an internal surface, and wherein the one or more second alignment elements intersect the internal surface when the carrier and terminated cable assemblies are in an assembled configuration.

3. The electrical connector assembly of claim 2, wherein the one or more second alignment elements are positioned in one or more corresponding contact pin receiving apertures of the carrier when the carrier and terminated cable assemblies are in an assembled configuration.

4. The electrical connector assembly of claim 1, wherein the carrier further comprises an internal surface, and wherein the first alignment elements extend from the internal surface.

5. The electrical connector assembly of claim 4, wherein each of the first alignment elements is configured to be positioned in a portion of a terminated cable assembly when the carrier and terminated cable assemblies are in an assembled configuration.

6. The electrical connector assembly of claim 4, wherein each of the first alignment elements is configured to guide a terminated cable assembly during insertion of the terminated cable assembly into the carrier.

7. The electrical connector assembly of claim 1, wherein one or both of the first and second alignment elements are configured to guide and position the plurality of terminated cable assemblies in the carrier.

8. The electrical connector assembly of claim 1, wherein each terminated cable assembly further comprises an outer plane, and wherein the first alignment elements intersect the outer plane when the carrier and terminated cable assemblies are in an assembled configuration.

9. The electrical connector assembly of claim 1, wherein each terminated cable assembly further comprises an outer surface, and wherein the one or more second alignment elements extend from the outer surface.

10. The electrical connector assembly of claim 1, wherein the first and second alignment elements, at least a portion of the carrier, and at least a portion of the terminated cable assemblies are cooperatively configured in an impedance controlling relationship.

11. A discrete electrical connector suitable for insertion into a carrier comprising:

an electrical cable including one or more conductors and a ground shield surrounding the one or more conductors;

one or more electrical contacts connected to the one or more conductors;

an insulator disposed around the one or more electrical contacts;

an electrically conductive shield element disposed around the insulator and connected to the ground shield; and at least one second alignment element disposed at a front end of the electrical connector, the front end configured to receive a contact pin of a mating header, the second alignment element configured to cooperate with at least one first alignment element of the carrier to align the electrical connector in the carrier.

12. The electrical connector of claim 11, wherein the insulator comprises a front end set back from at least one of a front end of the electrically conductive shield element and a front end of the one or more electrical contacts.

13. The electrical connector of claim 11, wherein the one or more electrical contacts comprise a front end that is one of set back from and set forward of a front end of the electrically conductive shield element.

14. The electrical connector of claim 11, wherein the electrically conductive shield element comprises at least one carrier rib receiving aperture configured to receive at least a portion of a carrier rib.

15. The electrical connector of claim 11, wherein at least one of the electrically conductive shield element and the insulator comprises at least one alignment aperture configured to receive at least a portion of the at least one first alignment element of the carrier.

16. The electrical connector of claim 11, wherein the at least one second alignment element is incorporated in the electrically conductive shield element.

17. The electrical connector of claim 11, wherein the electrically conductive shield element comprises one or both of at least one contact element deflecting rail and at least one contact element deflecting tab.

18. The electrical connector of claim 11, wherein at least a portion of the electrically conductive shield element is recessed to facilitate insertion of a contact element of a mating header.

19. A carrier comprising a front wall and a plurality of first alignment elements disposed at the front wall, the front wall configured to receive a plurality of contact pins of a mating header, the plurality of first alignment elements configured to cooperate with a plurality of second alignment elements of a plurality of mating discrete terminated cable assemblies to align the plurality of terminated cable assemblies in the carrier.

20. The carrier of claim 19, wherein the first alignment elements comprise at least a portion of a plurality of alignment ribs and an alignment tab.

21. The carrier of claim 19, wherein the first alignment elements comprise an alignment post.

22. The carrier of claim 21, wherein the alignment post comprises an opening configured to guide and position an electrical contact of a terminated cable assembly during insertion of the terminated cable assembly into the carrier.

23. The carrier of claim 19, wherein the first alignment elements comprise at least a portion of a contact pin receiving aperture.

24. The carrier of claim 19, wherein the first alignment elements comprise a second alignment element receiving aperture.

25. An electrical connector system comprising:

a carrier comprising a front wall and a plurality of first alignment elements disposed at the front wall, the front wall configured to receive a plurality of contact pins of a mating header;

a plurality of discrete terminated cable assemblies retained by the carrier each terminated cable assembly comprising a front end and one or more second alignment elements disposed at the front end, the front end configured to receive a contact pin of a mating header; and a header configured to mate with the carrier, wherein the first and second alignment elements are configured to cooperatively align the plurality of terminated cable assemblies in the carrier.

* * * * *